United States Patent [19]

Thompson

[11] 4,122,893

[45] Oct. 31, 1978

[54] AIR CONDITIONING SYSTEM

[75] Inventor: Roger L. Thompson, Sherrard, Ill.

[73] Assignee: American Air Filter Company, Inc., Louisville, Ky.

[21] Appl. No.: 774,585

[22] Filed: Mar. 7, 1977

[51] Int. Cl.[2] ..... F25B 29/00

[52] U.S. Cl. ..... 165/16; 62/160; 165/22; 165/28; 165/62; 237/2 B

[58] Field of Search ..... 165/16, 22, 28, 62; 62/160, 180; 237/2 B

[56] References Cited

U.S. PATENT DOCUMENTS

| | | | |
|---|---|---|---|
| 3,823,572 | 7/1974 | Cochran | 62/160 |
| 4,054,035 | 10/1977 | Trelease | 165/16 X |

*Primary Examiner*—Charles J. Myhre
*Assistant Examiner*—Margaret A. LaTulip
*Attorney, Agent, or Firm*—Jon C. Winger

[57] ABSTRACT

An air conditioning system, particularly well suited for use in a multi-zoned building, includes an air conditioning unit for each zone. These air conditioning units can be either all reversible cycle air cooling and heating units or a mix of reversible cycle units and air cooling only units. Each unit, regardless of whether it is a reversible cycle or cooling only unit, has a refrigerant-water contacted coil and a refrigerant-air contacted coil. The refrigerant-water contacted coil of all the units are interconnected by a closed loop water circulation circuit. At least one of these units has air ducts for passing out-of-doors air across its refrigerant-air contacted coil and into the building zone served by it. When the temperature of the water in the closed loop circuit is above a predetermined value, the temperature of the out-of-doors air is below the temperature of the air within the served zone, and the temperature of the air within the served zone is above a pre-set value, the refrigerant compressor of unit serving that zone is deactivated and an adequate amount of out-of-doors air is allowed to pass into the zone for cooling the zone air. However, when the temperature of the closed loop circuit falls below the predetermined value and the temperature of the air within the served zone is above the pre-set value, the refrigerant compressor of the unit serving that zone is re-activated and the amount of out-of-doors air allowed to pass into the zone is decreased to a point, or completely stopped, whereat it is no longer adequate for cooling the zone air even though the temperature of the out-of-doors air be sufficiently below the temperature of the air in the served zone to effect cooling.

10 Claims, 2 Drawing Figures

AIR CONDITIONING SYSTEM

BACKGROUND OF THE INVENTION

The present invention pertains to heating and cooling systems, and more particularly to a multi-zone heating and cooling system incorporating a closed loop water circulation circuit and ventilation air control.

Multi-zone air heating and cooling systems having a plurality of reversible cycle units interconnected in a closed loop water circulation circuit are known. Further, such systems having ventilation air controls are also known.

In known systems comprising a plurality of reversible cycle units interconnected in a closed loop water circulation circuit, heat is extracted from the air passing through those units which are cooling and transferred to the water in the closed loop circuit wherein it accumulates for use by other units which are heating the air passing through them. The units which are heating air extract the accumulated heat from the water in the closed loop circuit to heat the air passing through them, thus, conserving energy.

In such systems, the water temperature must be maintained within a certain temperature range. If the water temperature falls below the lower limit of this range there will not be sufficient heat in the water for efficient heat transfer to the units which are heating the air passing through them. When the water temperature drops below the low temperature limit of the range supplemental heat must be added to it by means of a supplemental water heater. This, of course, requires the input of energy which is becoming increasingly costly.

Other known systems of this type also include an out-of-doors air ventilation-cooling system. In addition to merely adding some amount of out-of-doors air sufficient for ventilation purposes, these systems also provide an adequate amount of out-of-doors air, over and above that amount which may be required for merely ventilation purposes, to provide a natural cooling of the air within a building zone served by, at least one of, the reversible cycle units of the system. When the out-of-doors air temperature is below the zone air temperature of a zone requiring cooling, the compressor of the reversible cycle unit serving that zone is deactivated and the cooler out-of-doors air is conveyed to the served zone, thus, cooling the served zone air and conserving the energy which would otherwise be consumed by the compressor. As long as the out-of-doors air temperature is below the air temperature in a zone requiring cooling, out-of-doors air is used for cooling and the compressor of the unit serving that zone remains deactivated, regardless of the temperature of the water in the closed loop circuit. While out-of-doors air is being used to cool the served zone air, no heat is being transferred by the unit serving that zone to the water in the closed water loop circuit. Thus, gradually the temperature of the water in the closed loop drops as other units of the system in a heating mode of operation extract heat from the water in the closed loop circuit. In time, the temperature of the water drops below the low temperature limit of the required water temperature range and the supplemental heater is activated to heat the water back into the required range.

This presents a problem to which the prior art does not address itself. At this point, there exists two conflicting operating conditions. One condition (cooling of zones using out-of-doors air) saving energy, and the other condition (using a supplementary heater to heat the water in the closed loop) expending energy. Unfortunately, these two conditions do not balance each other. It has been determined in practice that it requires more energy to add the necessary heat to the water by means of, for example, an electric heater than is used by the compressor in transferring the same amount of necessary heat from the air in the overheated space or space requiring cooling to the water.

SUMMARY OF THE INVENTION

The present invention not only recognizes this problem, but provides an effective solution which is simple, straightforward and inexpensive.

More particularly, the present invention is a heating and cooling system for controlling the air temperature within a plurality of zones in a building, the system comprising:

(a) at least one reversible cycle air cooling and heating unit for heating and cooling the air in each zone, each reversible cycle unit comprising:

at least one refrigerant-water contacted coil;

at least one refrigerant-air contacted coil;

a refrigerant compressor;

refrigerant expansion means;

refrigerant flow control means operable to selectively cause the refrigerant-air contacted coil to function as a refrigerant condensor and the refrigerant-water contacted coil to function as a refrigerant evaporator, or cause the refrigerant-air contacted coil to function as a refrigerant evaporator and the refrigerant-water contacted coil to function as a refrigerant condensor;

a refrigerant carrying conduit providing a closed path for refrigerant between the refrigerant-water contacted coil, the compressor, refrigerant expansion means, and refrigerant control means; and, means for selectively recirculating a variable volume rate of flow of served zone air in heat exchange relationship through the refrigerant-air contacted coil;

(b) a water carrying closed loop circulation circuit connected with the refrigerant-water contacted coil of each reversible cycle air heating and cooling unit of the system so that the water flowing from the closed loop circuit through the refrigerant-water contacted coils functioning as refrigerant condensors extracts heat from the refrigerant flowing through the refrigerant-water contacted coil and the extracted heat accumulates in the water flowing in the closed loop circuit, and so that the water flowing from the closed loop circuit through the refrigerant-water contacted coils functioning as refrigerant evaporators yields heat to the refrigerant flowing through the refrigerant-water contacted coils;

(c) energy economizer means comprising:

means for selectively preventing activation of the refrigerant compressor of at least one preselected reversible cycle unit when the temperature of the water in the water carrying closed loop circulation circuit is above a predetermined water temperature value, when the out-of-doors air temperature is lower than the air temperature in the zone served by the preselected reversible cycle unit, and when the zone air temperature is above a predetermined zone air temperature value; and, means for selectively passing an appropriate volume rate of flow of out-of-doors air through the refrigerant-air contacted coil of the at least one preselected reversible cycle and into the zone served by the preselected reversible cycle unit to cool the zone air to the predetermined zone air temperature value; and, (d) economizer override means comprising:

means for selectively activating the refrigerant compressor of the at least one preselected reversible cycle unit when the temperature of the water in the water carrying closed loop circulation circuit is below the predetermined water temperature value regardless of whether the out-of-doors air temperature is lower than the same as or higher than the air temperature in the zone served by the preselected reversible cycle unit, and when the air temperature in the zone served by the preselected reversible unit is above the predetermined zone air temperature value; and, means for selectively reducing the volume rate of flow of out-of-doors air through the refrigerant-air contacted coil of the at least one preselected reversible cycle unit and into the zone served by the preselected reversible cycle unit to a value whereat it is no longer adequate to cool the zone air to the predetermined zone air temperature value so that heat is extracted from the air passing through the refrigerant-air contacted coil by the refrigerant passing therethrough and subsequently extracted from the refrigerant by the water passing through the refrigerant-water contacted coil to heat the water flowing in the closed loop circulation circuit back to at least the predetermined water temperature value.

BRIEF DESCRIPTION OF THE DRAWINGS

A better understanding of the present invention will be achieved upon reference to the accompanying specification and by reference to the following drawings wherein like numerals refer to like parts throughout, and in which.

DETAILED DESCRIPTION OF THE PREFERRED EMBODIMENT

Figure 1:
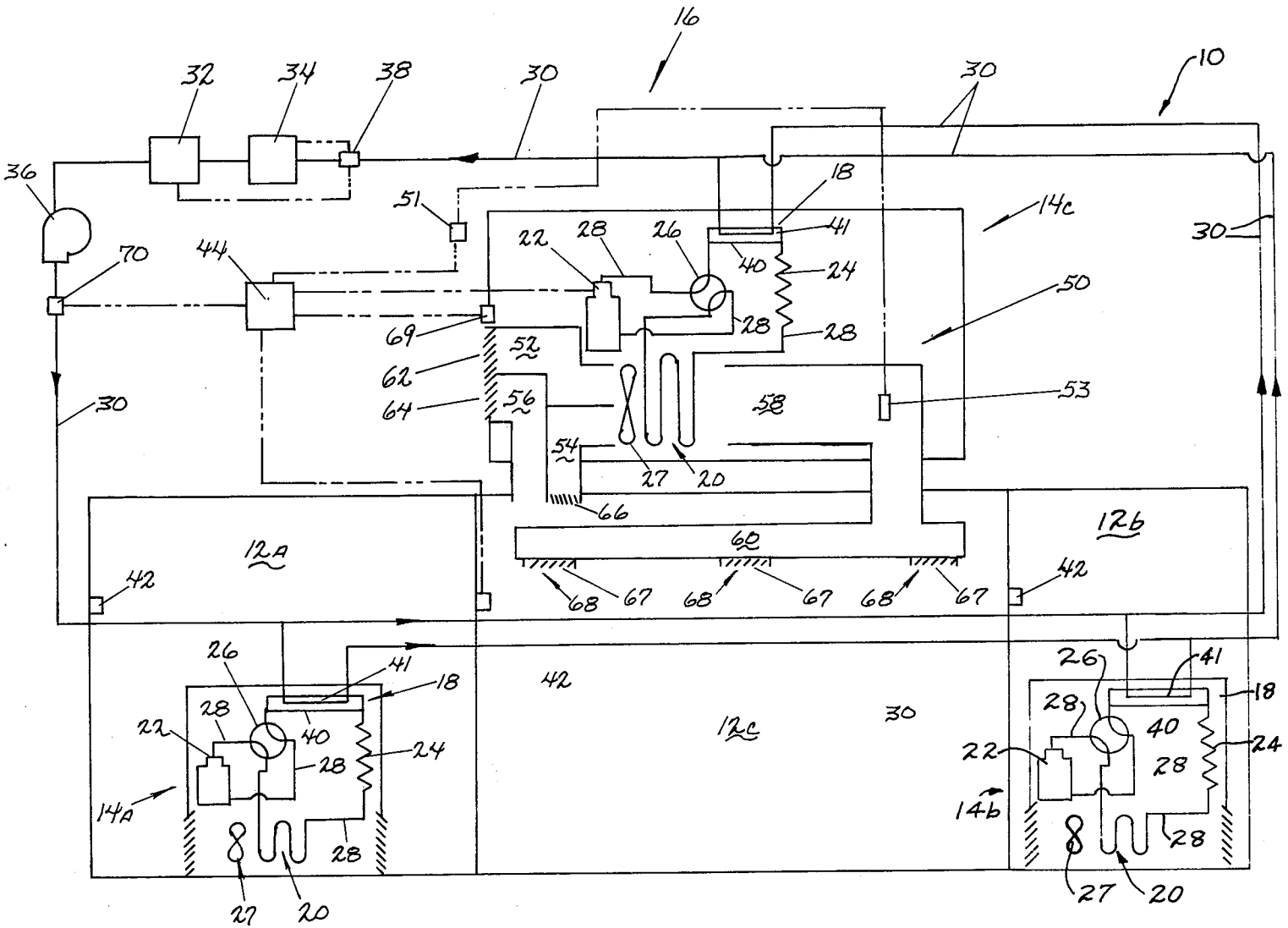
FIG. 1 is a schematic view of an advantageous embodiment of a multi-zoned reversible cycle heating and cooling system serving a plurality of zones within an enclosure; and, FIG. 2 is a schematic view of another advantageous embodiment of a multi-zoned reversible cycle heating and cooling system serving a plurality of zones within an enclosure.

With reference to FIG. 1, there is shown an enclosure, such as a building, generally denoted as the numeral 10, divided into a plurality of zones or rooms 12*a, b*, and *c* (only three being illustrated for the sake of clarity).

A multi-zoned reversible cycle heating-cooling system for controlling the temperature of the air within the zones 12*a, b* and *c* is illustrated as comprising a reversible cycle heating-cooling unit in each of the several zones, the reversible cycle units being denoted by the numerals 14*a*, 14*b* and 14*c*, and a closed loop water circulation circuit, generally denoted as the numeral 16, for conveying water between the several reversible cycle units 14*a*, 14*b* and 14*c*.

The individual reversible cycle air heating-cooling units 14*a*, 14*b* and 14*c* each comprise at least one refrigerant-water contacted coil such as, for example, a tube-in-tube coil 18, at least one refrigerant-air contacted coil 20, a refrigerant compressor 22, refrigerant expansion means 24, refrigerant flow control means such as a reversing valve 26; and an air moving fan 27. A refrigerant carrying conduit 28 interconnects and provides a closed path for refrigerant between the refrigerant-water contacted coil 18, refrigerant-air contacted coil 20, the refrigerant compressor 22, refrigerant expansion means 24, and refrigerant flow control means 26.

The closed loop water circulation circuit 16 comprises a water circulation conduit 30; a heat rejector 32, such as an evaporative water cooler, in fluid flow communication with the water flowing in the conduit 30; a water heater 34, such as an electric heater, also in fluid flow communication with the water flowing in the conduit 30; a water pump 36 connected in the conduit 30 to pump the water through the closed loop water circulation circuit in a direction indicated by the arrowheads; and a water temperature sensor 38 operatively connected to the heat rejector 32 and water heater 34.

Referring again to the individual heating-cooling units 14*a*, 14*b* and 14*c*, each tube-in-tube refrigerant-water contacted coil 18 comprises an outer conduit 40 for refrigerant flow communication, via the refrigerant carrying conduit 28, with the refrigerant-water contacted coil 18, the refrigerant-air contacted coil 20, the refrigerant compressor 22, refrigerant expansion means 24 and refrigerant flow control means 26, and an inner conduit 41 for water flow communication with the water circulation conduit 30.

Typically, each zone 14*a*, 14*b* and 14*c* has a thermostat 42 operatively connected through, for example, a central control means 44, to the refrigerant compressor 22, reversing valve 26 and air moving fan 27 of the reversible cycle unit serving the zone in which it is located thereby controlling the heat and cooling function of that reversible cycle unit in response to varying zone air temperature requirements and conditions as is known in the art.

In FIG. 1, each reversible cycle heating-cooling unit 14*a* and 14*b* has received via the central control means 44, a demand signal for heat from the thermostat 42 in its respective zone. In response to this signal, in each unit 14*a* and 14*b*, the reversing valve 26 has been caused to move to a position to direct hot high pressure refrigerant gas from the high pressure side of the compressor 22 to the refrigerant-air contacted coil 20. The air moving fan 27 moves zone air across the refrigerant-air contacted coil 20. As the zone air to be heated passes across the refrigerant-air contacted coil 20 it absorbs heat from the hot refrigerant gas in the coil 20 and the gaseous refrigerant condenses to a liquid. The heated air is discharged to the zone and the now liquid refrigerant flows from the refrigerant-air contacted coil 20 through the expansion means 24, such as, for example, a capillary or thermostatically controlled expansion valve wherein the pressure of the liquid refrigerant is reduced. From the capillary 24, the liquid refrigerant then flows through the outer conduit 40 of the tube-in-tube refrigerant-water contacted coil 18 which serves in this instance as a refrigerant evaporator. In the refrigerant-water contacted coil 18 the refrigerant absorbs heat from the water flowing through the inner conduit 41, thus, causing the refrigerant to vaporize, and, at the same time cooling the water. The refrigerant vapor then flows through the reversing valve 26 and back to the low pressure side of the refrigerant compressor 22, thus, completing a heating cycle. The compressor 22 recompresses the low pressure refrigerant vapor and the cycle is repeated.

The reversible cycle heating-cooling unit 14*c* in FIG. 1 has received, via the central control means 44, a demand signal for cooling from the thermostat 42 located in the zone it serves. In response to this signal, the reversing valve 26 has been caused to move to a position to direct hot high pressure refrigerant gas from the high pressure side of the compressor 22 to the outer tube 40 of the tube-in-tube refrigerant-water contacted coil 18 which serves in this instance as a refrigerant condensor. In the coil 18, heat is removed from the hot refrigerant gas by the water flowing through the inner conduit 41, thus, cooling the refrigerant which then condenses into a liquid, and, at the same time heating the water flowing in the inner conduit 41. The liquid refrigerant then flows from the refrigerant-water contacted coil 18 through the expansion means 24 wherein the pressure of the liquid refrigerant is reduced. From the expansion means 24, the low pressure refrigerant flows to the refrigerant-air contacted coil 20. The air moving fan 27 moves air to be conditioned across the refrigerant-air contacted coil 20. As the air to be cooled passes across the refrigerant-air contacted coil 20, the low pressure refrigerant absorbs heat from the air, thus, cooling the air and vaporizing the refrigerant. The cooled air is discharged to the zone and the now refrigerant vapor flows through the refrigerant flow control reversing valve 26 and back to the low pressure side of the refrigerant compressor 22, thus, completing the cooling cycle. The compressor recompresses the refrigerant gas to a high pressure hot gaseous state and the cooling cycle is repeated.

The above described sequence of operation of the reversible cycle unit **14*c* in the cooling mode applies also the the reversible cycle units 14*a* and 14*b* when they are in the cooling mode. Likewise, the above described sequence of operation of the reversible cycle units 14*a* and 14*b* in the heating mode applies also to the reversible cycle unit 14*c*** when it is in the heating mode.

The reversible cycle air heating and cooling system of FIG. 1 also includes an out-of-doors air ventilation system 50. Such a ventilation system could be associated with any one or more, or for that matter all of the reversible cycle air heating and cooling units of the system. However, for the sake of clarity of the drawing, the out-of-doors air ventilation system 50 is illustrated as being only associated with the reversible cycle unit **14*c***.

For the sake of discussion, we shall assume that the zone **12*c* served by the reversible cycle unit 14*c* is an interior or core zone of the building and that the zones 12*a* and 12*b* served by the reversible cycle units 14*a* and 14*b* are peripheral zones. This, for example, would be a typical building layout for a school wherein the zones 12*a* and 12*b* served by the units 14*a* and 14*b* are classrooms and the zone 12*c* served by the unit 14*c* is an auditorium. For this reason, the peripheral zones 12*a* and 12*b* usually experience a substantial amount of heat transfer through their exterior walls with the out-of-doors, while the core zone 12*c* experiences little heat transfer through its walls. Thus, during those times of the year when the out-of-doors air temperature is cooler than that required for human comfort, such as typically occurs during early spring, late fall or winter, the peripheral zones 12*a* and 12*b* may require heating while the interior zone 12*c* may concurrently require cooling. This condition typically occurs when the interior zone 12*c* is occupied by a large number of people. Because there is little heat transfer through the walls of the interior zone 12*c*, the heat produced by the occupants accumulates in the central zone and the air temperature soon increases above a comfortable predetermined zone air temperature corresponding to the set-point of the thermostat 42 in the interior zone 12*c*. Thus, even in the dead of winter, while the peripheral zones 12*a* and 12*b* may be requiring heat, the interior zone 12*c* may require cooling. In order to accomplish cooling of the interior zone and heating of peripheral zones, and still conserve energy, the heating and cooling system further comprises economizer means comprising means for deactivating the compressor 22 and means for conveying an appropriate amount of out-of-doors air to the interior zone 12*c*** to effect "natural" cooling.

The means for conveying an appropriate amount of out-of-doors air to the interior zone **12*c* comprises a ventilation system 50 having an out-of-doors passage 52 for selectively conveying a variable amount of out-of-doors air through the refrigerant-air contacted coil 20, a zone air return passage 54 for selectively conveying a variable amount of air from the interior zone back to the refrigerant-air contacted coil 20, a zone air exhaust passage 56 for selectively exhausting a variable amount of zone air to the out-of-doors, and supply air passage 58 for conveying supply air from the refrigerant-air contacted coil 20 to an air distribution system 60 for selectively distributing the supply air into the served zone. The supply air can be comprised of either 100% out-of-doors air, 100% recirculated zone air, or a mixture of out-of-doors air and recirculated zone air. The composition of the supply air can be selectively controlled by means of movable dampers 62 located in the out-of-doors air passage, movable dampers 64 located in the exhaust air passage, movable dampers 66 located in the zone air return passage, and movable dampers 67 over outlets 68 from the air distribution system 60. The position of these dampers can be controlled through, for example, damper activator means 69 activated by the central control means 44** responsive to various preselected criteria as is well known in the art.

The heating and cooling unit **14*c* comprises an out-of-doors air temperature sensor 51 operatively connected to the central control means 44, and a supply air temperature sensor 53 disposed within the supply air passage 58 and operatively connected to the central control means 44. The central control means is operatively connected to the compressor 22. Thus, the central control means 44 receives signals from the zone thermostat 42, the out-of-doors air temperature sensor 51, and the supply air temperature sensor 53. When the served zone air temperature rises above the desired temperature for the zone air as established by the set-point of the thermostat 42, the zone air thermostat 42 sends a signal to the central control means 44 asking for cool air. The central control means 44 also receives a signal from the out-of-doors air temperature sensor 51. If the out-of-doors air temperature is below an arbitrary preselected temperature, such as, for example 70° F., the central control means 44 signals the damper activator means 69 to progressively open the out-of-doors air passage dampers 62 and progressively close the recirculation zone air passage dampers 66, thus allowing at least some out-of-doors air to enter the heating-cooling unit 14*c* and pass therethrough to the supply air passage 58. The central control means 44 receives a temperature signal from the supply air temperature sensor 53 and compares this temperature with the served zone air temperature. The central control means 44 progressively opens the out-of-doors air dampers 62 between their fully closed position and fully open position, and closes the recirculation zone air dampers 66 between their fully open position and fully closed position until the temperature of the air flowing through the supply air passage 58 to the served zone calling for cooling can satisfy the cooling demand of the served zone 12***c*. If the temperature of the air in the supply air passage 58 can satisfy the served zone cooling demand, the central control means 44 prevents activation of the compressor 22. If the make up of the air in the supply air passage 53 is composed of 100% out-of-doors air and the temperature of this 100% out-of-doors air is not adequate to satisfy the cooling demand of the served zone, the central control means 44 will activate the compressor 22 to initiate mechanical cooling by the heating-cooling unit 14*c*. The out-of-doors air dampers 62 will remain open as long as the out-of-doors air temperature is below the arbitrary preselected temperature, i.e., 70° F. in this example. If the out-of-doors air temperature is above this preselected temperature, the out-of-doors air dampers will be closed by the central control means. It should be pointed out at this time that an out-of-doors air temperature of 70° F. is used in this example because usually a comfortable zone air temperature is 70° F. In this instance then, if out-of-doors air hotter than 70° F. was routed to the served zone, it would not satisfactorily cool the served zone air. However, depending upon the desires of the occupants of the building, the out-of-doors air temperature sensor 51 can be set at any other temperature.

During operation of the heating-cooling system, the temperature of the water in the closed loop circulation conduit 30 must not be allowed to become too cool or too hot. If the water becomes too cool, effective heat transfer to the refrigerant in the refrigerant-water contacted coil of those reversible cycle units which are in the air heating mode will be impaired. On the other hand, if the water becomes too hot, the system may be damaged. In practice a suitable predetermined low water temperature limit has been determined to be approximately 60° F., and a suitable high water temperature limit has been determined to be approximately 90° F. The water temperature sensor 38 monitors the water temperature and when the water temperature falls below the predetermined low limit value, supplemental heat must be added to the water by means of, for example, the electric heater 34. The addition of heat by such means, of course, requires additional energy. Likewise, when the water temperature rises above the predetermined high limit value, heat must be extracted from the water by means of the heat rejector 32.

However, while the compressor 22 of the reversible cycle unit 14*c* is idle and the core zone 12*c* is being cooled by out-of-doors air and excess heat being exhausted to the out-of-doors, it is not adding any heat to the water in the closed loop conduit 30. Simultaneously, however, at least some of the other heating-cooling units such as units 14*a* and 14*b*, of the system are in the heating mode, thus, extracting heat from the water in the closed loop conduit 30. Eventually, if this situation were allowed to continue as in the prior art, the temperature of the water in the closed loop conduit 30 will decrease and finally fall below the low water temperature limit and the electric heater 34 is activated to reheat the water. It has been established in practice that more energy is expended by the electric furnace in reheating the water in the closed loop conduit 30 than is saved by the deactivated compressor of the reversible cycle unit taking in out-of-doors air to cool the served zone in those instances where the compressor would be operated only to transfer heat energy from the air being routed to the served zone to the water in the closed loop circuit to maintain the water temperature within the predetermined temperature range but not cool the served zone.

The heating-cooling system of the present invention further includes an economizer override means comprising the water temperature sensor 70 operatively connected to the compressor through the central control means 44. By means of the water temperature sensor 70, the central control means 44 activates the compressor 22 of the reversible cycle unit 14*c* when the water temperature in the closed water loop conduit 30 has dropped to a predetermined water temperature above the low water temperature limit. The choice of this predetermined water temperature is arbitrary and will depend upon the geographic region and individual requirements of the user. For example, a predetermined water temperature of 85° F. seems to work well. When the water temperature has dropped to the predetermined water temperature, the central control means 44 causes the out-of-doors air passage dampers 62 to close to a point whereat the volume rate of flow of out-of-doors air passing through the heating-cooling unit 14*c* and into the zone 12*c* is no longer adequate to cool the air in the served zone 12*c* even though the out-of-doors air temperature is below the predetermined temperature or is otherwise adequate to cool the served zone air Concurrently with the closing of the out-of-doors air passage dampers 62, the zone air return dampers 66 may be opened enough to make up for the decreased volume of out-of-doors air flowing into the zone to prevent a low air pressure atmosphere from being created in the served zone. Because there is no longer an adequate amount of out-of-doors air being admitted to the served zone 12*c* to naturally cool the air within it, the reversible cycle unit 14*c* must mechanically cool the air flowing across the refrigerant-air contacted coil 20 which cool air is then distributed into the zone by means of the supply air passage 58 and air distribution system 60. To cool the air, the refrigerant flowing in the refrigerant-air contacted coil 20 extracts heat from the air as the air flows across the refrigerant-air contacted coil. The refrigerant then flows to the refrigerant-water contact coil 18 wherein the accumulated heat is extracted from the refrigerant by the water for use by other reversible cycle units which are in an air heating mode. Therefore, the water flowing in the closed loop conduit 30 is reheated without the necessity of activating the supplemental water heater 38 and a net savings of energy is realized.

Figure 2:
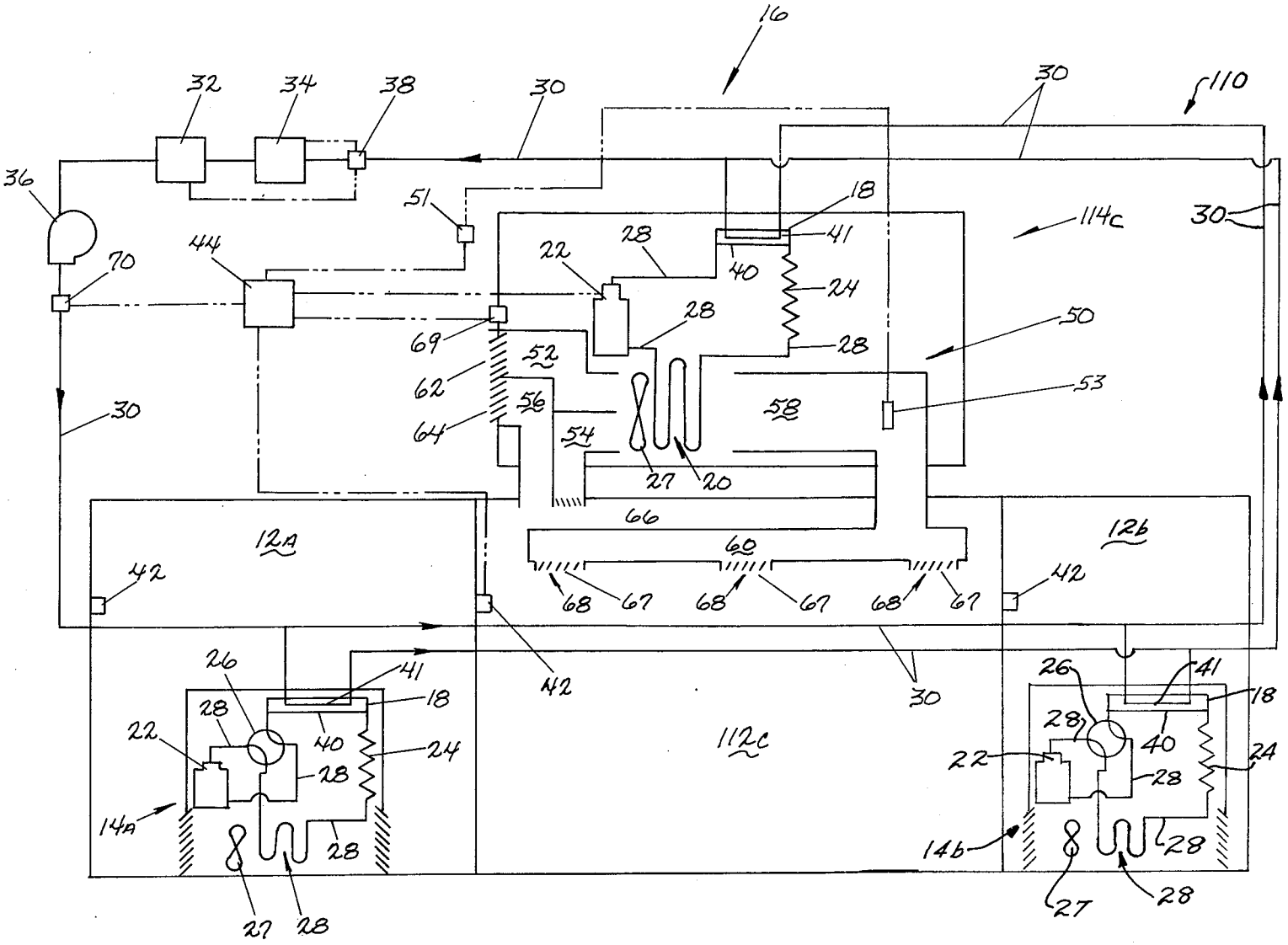

FIG. 2 illustrates a heating and cooling system 110 substantially identical to the heating and cooling system 10 of FIG. 1 except that the reversible cycle unit 14*c* serving the central or core zone 12*c* has been replaced with an air cooling only unit 114*c*. The air cooling only unit 114*c* is virtually identical to the reversible cycle unit 14*c* except that it does not have the refrigerant flow reversing valve 26, therefore, the refrigerant-water contacted coil always functions as a refrigerant condensor. This system finds particular application in buildings wherein the central or core zone 12*c* never requires heating. In all other respects and in operation, the cooling only unit 114*c* is the same as the reversible cycle unit 14*c* operating in the cooling mode and described above.

The foregoing detailed description is given primarily for clearness of understanding and no unnecessary limitations should be understood therefrom for modifications will be obvious to those skilled in the art upon reading this disclosure and can be made without departing from the spirit of the invention or the scope of the appended claims.

What is claimed is:

1. A heating and cooling system for controlling the air temperature within a plurality of zones in a multi-zoned building, the system comprising:

(a) at least one reversible cycle air cooling and heating unit for heating and cooling the air in each zone, each reversible cycle unit comprising:
at least one refrigerant-water contacted coil;
at least one refrigerant-air contacted coil;
a refrigerant compressor;
refrigerant expansion means;
refrigerant flow control means operable to selectively cause the refrigerant-air contacted coil to function as a refrigerant condensor and the refrigerant-water contacted coil to function as a refrigerant evaporator, or cause the refrigerant-air contacted coil to function as a refrigerant evaporator and the refrigerant-water contacted coil to function as a refrigerant condensor;
a refrigerant carrying conduit providing a closed path for refrigerant between the refrigerant-water contacted coil, the refrigerant-air contacted coil, the compressor, refrigerant expansion means, and refrigerant control means; and, (b) a water carrying closed loop circulation circuit connected with the refrigerant-water contacted coil of each reversible cycle air heating and cooling unit of the system so that the water flowing from the closed loop circuit through the refrigerant-water contacted coils functioning as refrigerant condensors extracts heat from the refrigerant flowing through the refrigerant-water contacted coil and the extracted heat accumulates in the water flowing in the closed loop circuit, and so that the water flowing from the closed loop circuit through the refrigerant-water contacted coils functioning as refrigerant evaporators yields heat to the refrigerant flowing through the refrigerant-water contacted coils;

(c) energy economizer means comprising:
means for selectively preventing activation of the the refrigerant compressor of at least one preselected reversible cycle units when the temperature of the water in the water carrying closed loop circulation circuit is above a predetermined water temperature value, when the out-of-doors air temperature is lower than the air temperature in the zone served by the preselected reversible cycle unit, and when the zone air temperature is above a predetermined zone air temperature value;
means for selectively passing an appropriate volume rate of flow of out-of-doors air through the refrigerant-air contacted coil of the at least one preselected reversible cycle unit and into the zone served by the preselected reversible cycle unit to cool the zone air to the predetermined zone air temperature value; and, (d) economizer override means comprising:
means for selectively activating the refrigerant compressor of the at least one preselected reversible cycle unit when the temperature of the water in the water carrying closed loop circulation circuit is below the predetermined water temperature value regardless of whether the out-of-doors air temperature is lower than the temperature in the zone served by the preselected reversible cycle unit, and when the air temperature in the zone served by the preselected reversible unit is above the predetermined zone temperature value; and,
means for selectively reducing the volume rate of flow of out-of-doors air through the refrigerant-air contacted coil of the at least one preselected reversible cycle unit and into the zone served by the preselected reversible cycle unit to a value whereat it is no longer adequate to cool the zone air to the predetermined zone air temperature value so that heat is extracted from the air passing through the refrigerant-air contacted coil by the refrigerant passing therethrough and subsequently extracted from the refrigerant by the water passing through the refrigerant-water contacted coil to heat the water flowing in the closed loop circulation circuit back to at least the predetermined water temperature value.

2. The heating and cooling system of claim 1, further comprising means for selectively recirculating a variable volume rate of flow of served zone air in heat exchange relationship through the refrigerant-air contacted coil of the at least one preselected reversible cycle unit and back into the zone served thereby.

3. The heating and cooling system of claim 1, further comprising means for selectively exhausting a variable volume rate of flow of served zone air to the out-of-doors.

4. The heating and cooling system of claim 1, further comprising:
a water heater for adding heat to the water flowing in the water carrying closed loop circulation circuit when the water temperature drops below a predetermined low water temperature limit; and,
a heat extractor for removing heat from the water flowing in the water carrying closed loop circulation circuit when the water temperature rises above a predetermined high water temperature limit.

5. The heating and cooling system of claim 4 wherein:
the predetermined low water temperature limit is approximately 60° F.; and,
the predetermined high water temperature limit is approximately 90° F.

6. A heating and cooling system for controlling the air temperature within a plurality of zones in a building, the system comprising:

(a) at least one air cooling unit for cooling the air in at least one zone of the building, the air cooling unit comprising:
at least one refrigerant-water contacted coil functioning as a refrigerant condensor;
at least one refrigerant-air contacted coil functioning as a refrigerant evaporator;
a refrigerant compressor;
refrigerant expansion means;
a refrigerant carrying conduit providing a closed path for refrigerant between the refrigerant-water contacted coil, refrigerant-air contacted coil, the refrigerant compressor and the refrigerant expansion means;

at least one reversible cycle air cooling and heating unit for heating and cooling the air in each of the zones not served by the air cooling unit, the reversible cycle air cooling and heating unit comprising:
at least one refrigerant-water contacted coil;

at least one refrigerant-air contacted coil;

a refrigerant compressor;

refrigerant expansion means;

refrigerant control means operable to selectively cause the refrigerant-air contacted coil to function as a refrigerant evaporator and the refrigerant-water contacted coil to function as a refrigerant condensor, or cause the refrigerant-air contacted coil to function as a refrigerant condensor and the refrigerant-water contacted coil to function as a refrigerant evaporator; and, a refrigerant carrying conduit providing a closed path for refrigerant between the refrigerant-water contact coil, the refrigerant-air contacted coil, the compressor, the refrigerant expansion means, and the refrigerant control means;

(c) a water carrying closed loop circulation circuit connected with the refrigerant-water contacted coil of the air cooling unit and the refrigerant-water contacted coil of each reversible cycle heating and cooling unit of the system so that the water flowing in the closed loop circuit through refrigerant-water contacted coils functioning as refrigerant condensors extracts heat from the refrigerant flowing through the refrigerant-water contacted coils and the extracted heat accumulates in the water flowing in the closed loop circuit, and so that the water flowing in the closed loop circuit through refrigerant-water contacted coils functioning as refrigerant evaporators yields the accumulated heat to the refrigerant flowing through the refrigerant-water contacted coils;

(d) energy economizer means comprising:

means for selectively preventing activation of the refrigerant compressor of the cooling unit when the temperature of the water in the water carrying closed loop circulation circuit is above a predetermined water temperature value, when the out-of-doors air temperature is below a predetermined temperature and when the zone air temperature is above a predetermined zone air temperature value; and, means for selectively passing an appropriate volume rate of flow of out-of-doors air through the refrigerant-air contacted coil of the cooling unit and into the zone served by the cooling unit to cool the zone air to the predetermined zone air temperature value; and, (e) economizer override means comprising:

means for selectively activating the refrigerant compressor of the cooling unit when the temperature of the water in the water carrying closed loop circulation circuit is below the predetermined water temperature value, even when the out-of-doors air temperature is lower than the predetermined temperature, and when the air temperature in the zone served by the cooling only unit is above the predetermined zone air temperature value; and, means for selectively reducing the volume rate of flow of out-of-doors air through the refrigerant-air contacted coil of the cooling unit and into the zone served by the cooling unit to a value whereat it is no longer adequate to cool the zone air to the predetermined zone air temperature value so that heat is extracted from the air passing through the refrigerant-air contacted coil by the refrigerant passing therethrough and subsequently extracted from the refrigerant by the water passing through the refrigerant-water contacted coil to heat the water flowing in the closed loop circulation circuit back to at least the predetermined water temperature value.

7. The heating and cooling system of claim 6, further comprising means for selectively recirculating a variable volume rate of flow of served zone air in heat exchange relationship through the refrigerant-air contacted coil of the air cooling unit and back into the zone served thereby.

8. The heating and cooling system of claim 6, further comprising means for selectively exhausting a variable volume rate of flow of air from the zone served by the air cooling unit to the out-of-doors.

9. The heating and cooling system of claim 6, further comprising:

a water heater for adding heat to the water flowing in the water carrying closed loop circulation circuit when the water temperature drops below a predetermined low water temperature limit; and, a heat extractor for removing heat from the water flowing in the water carrying closed loop circulation circuit when the water temperature rises above a predetermined high water temperature limit.

10. The heating and cooling system of claim 9, wherein:

the predetermined low water temperature limit is approximately 60° F.; and, the predetermined high water temperature limit is approximately 90° F.

* * * * *